US008231038B2

(12) United States Patent
Felts

(10) Patent No.: US 8,231,038 B2
(45) Date of Patent: Jul. 31, 2012

(54) AMMUNITION POUCH

(75) Inventor: Jeffrey G. Felts, Canton, MI (US)

(73) Assignee: Center Mass, Inc., Canton, MI (US)

( * ) Notice: Subject to any disclaimer, the term of this patent is extended or adjusted under 35 U.S.C. 154(b) by 401 days.

(21) Appl. No.: 12/550,622

(22) Filed: Aug. 31, 2009

(65) Prior Publication Data

US 2010/0176173 A1 Jul. 15, 2010

Related U.S. Application Data

(63) Continuation-in-part of application No. 12/353,508, filed on Jan. 14, 2009, and a continuation of application No. 29/335,815, filed on Apr. 22, 2009, now Pat. No. Des. 624,149.

(51) Int. Cl.
*A45F 5/00* (2006.01)
*F42B 39/00* (2006.01)

(52) U.S. Cl. ..... 224/665; 224/679; 224/680; 224/671

(58) Field of Classification Search ..... 224/660, 224/663, 665–667, 671, 672, 269, 679, 680
See application file for complete search history.

(56) References Cited

U.S. PATENT DOCUMENTS

| | | | | | |
|---|---|---|---|---|---|
| 1,059,187 | A | | 4/1913 | McKee | |
| 1,553,066 | A | * | 9/1925 | Burger | 224/242 |
| 1,756,677 | A | | 4/1930 | Cook | |
| 3,215,322 | A | * | 11/1965 | Boyer et al. | 224/610 |
| 3,300,109 | A | * | 1/1967 | Clark | 224/667 |
| 3,445,046 | A | | 5/1969 | Wilson | |
| 3,915,361 | A | * | 10/1975 | Perkins | 224/666 |
| 4,194,657 | A | | 3/1980 | Thor | |
| 4,214,686 | A | * | 7/1980 | Dostourian | 224/667 |
| 4,483,089 | A | | 11/1984 | Johnson | |
| 4,524,892 | A | * | 6/1985 | Ozeki | 224/256 |
| 4,597,213 | A | | 7/1986 | Musgrave | |
| 5,018,653 | A | * | 5/1991 | Shoemaker | 224/198 |
| 5,152,442 | A | | 10/1992 | Gallagher | |
| 5,174,482 | A | | 12/1992 | Rogers et al. | |
| 5,265,781 | A | * | 11/1993 | Nichols | 224/198 |
| 6,000,589 | A | | 12/1999 | Burdine | |
| 6,076,715 | A | | 6/2000 | Easter | |
| 6,154,997 | A | | 12/2000 | Aluotto et al. | |
| 7,025,238 | B2 | | 4/2006 | Hughes et al. | |
| 7,073,285 | B2 | | 7/2006 | Obong | |
| 7,194,837 | B2 | | 3/2007 | Obong | |
| 2007/0278269 | A1 | | 12/2007 | Rogers et al. | |

* cited by examiner

*Primary Examiner* — Justin Larson
*Assistant Examiner* — Corey Skurdal
(74) *Attorney, Agent, or Firm* — Young Basile

(57) ABSTRACT

A wearable item carrier includes a first container having a first side including a belt receiver and a second side opposite the first side including a container receiver. An generally inverted J-shaped paddle can be attached to the item carrier and engaged with a waistline of a garment or a belt of an individual wearing the item carrier to prevent the item carrier from flopping around if the individual makes a sudden movement or change in direction.

13 Claims, 7 Drawing Sheets

AMMUNITION POUCH

STATEMENT OF RELATED CASES

This application claims priority from pending U.S. patent application Ser. No. 12/353,508 filed Jan. 14, 2009 and from pending U.S. Design Patent Application Ser. No. 29/335,815 filed Apr. 22, 2009, both of which are incorporated herein in their entirety by reference

TECHNICAL FIELD

The invention relates to a device for holding ammunition, and more specifically a device for holding an ammunition magazine that can be carried on a utility belt.

BACKGROUND

An individual such as a police officer, a member of the military, or a security guard often carries numerous items including handcuffs, an electroshock weapon (e.g., a Taser), a handgun, a walkie-talkie or other communication device, a baton, spare ammunition and/or other items. Such an individual typically uses a separate item carrier, such as a holster or ammunition pouch, to carry each item, and the item carriers may be disposed along the length of a utility belt that is worn around the waist of the individual. As a result, the item carriers are spaced circumferentially about the waist of the individual when the individual wears the utility belt. For example, the individual may carry an ammunition pouch at one location on a utility belt, a handcuff container adjacent the ammunition pouch along the length of the utility belt, a pistol holster adjacent the handcuff container along the length of the utility belt, and so on.

Additionally, it is becoming increasingly common for individuals such as police officers, military personnel, and security guards to carry rifles or other firearms that accept ammunition stored in magazines.

SUMMARY

Due to the large amount of space often occupied on a utility belt by item carriers designed to carry items other than rifle magazines, a rifle-carrying individual may not have ample room on his utility belt to add one or more magazine pouches. As a result, many rifle-carrying individuals have resorted to carrying rifle ammunition magazines on their rifles or at other locations besides on their utility belts. However, carrying rifle ammunition magazines at locations other than on a utility belt can be problematic. For example, one carrying an ammunition magazine on his rifle may take longer to reload his weapon than if he were carrying the magazine in his utility belt. As another example, carrying a rifle ammunition magazine on a rifle can increase the likelihood that the rifle will malfunction.

A wearable item carrier, examples of which are described herein, can reduce the problems associated with carrying additional items by, for example, increasing the carrying capacity of a utility belt. For example, a magazine pouch as described herein can allow an individual wearing the pouch to carry more than one item while only occupying a length of a belt typically reserved for carrying just one item. The exemplary magazine pouch can allow an item carrier to be attached to an outboard side of the magazine pouch.

According to one example, a wearable item carrier includes a first container. A first side of the first container includes a belt receiver, and a second side of the first container opposite the first side includes a container receiver.

According to another example, a magazine pouch includes a main body defining an opening of sufficient size to receive an ammunition magazine. A belt receiver on a first side of the main body at least partially defines at least one first slot sized to receive a belt. A container receiver is on a second side of the main body opposite the first side.

According to yet another example, an ammunition magazine pouch includes means for receiving an ammunition magazine, means for applying a force to a received ammunition magazine in a direction opposing removal of the magazine, means for coupling a first side of the ammunition magazine pouch to a belt, and means for removeably coupling a second side of the ammunition magazine pouch opposite the first side to an item carrier.

According to still yet another example, a generally inverted J-shaped paddle can be attached to the item carrier and engaged with a waistline of a garment or a belt of an individual wearing the item carrier to prevent the item carrier from flopping around if the individual makes a sudden movement or change in direction.

BRIEF DESCRIPTION OF THE DRAWINGS

The description herein makes reference to the accompanying drawings wherein like reference numerals refer to like parts throughout the several views, and wherein.

DETAILED DESCRIPTION

FIGS. 1-12 illustrate examples of magazine pouches. In the example illustrated in FIG. 1, an individual 10 such as a police officer, a member of the military, or a security guard is wearing a utility belt 12. One end of the belt 12 can include a buckle 12*a*, clip, a hook-type Velcro strip or another attachment structure, while the other end of the belt 12 can define an aperture for receiving the buckle 12*a*, or include a clip receiving member or a loop-type Velcro strip, such that the ends of the belt 12 can be attached to one another. As a result, the individual 10 can wear the belt 12 around his or her waist.

Figure 1:
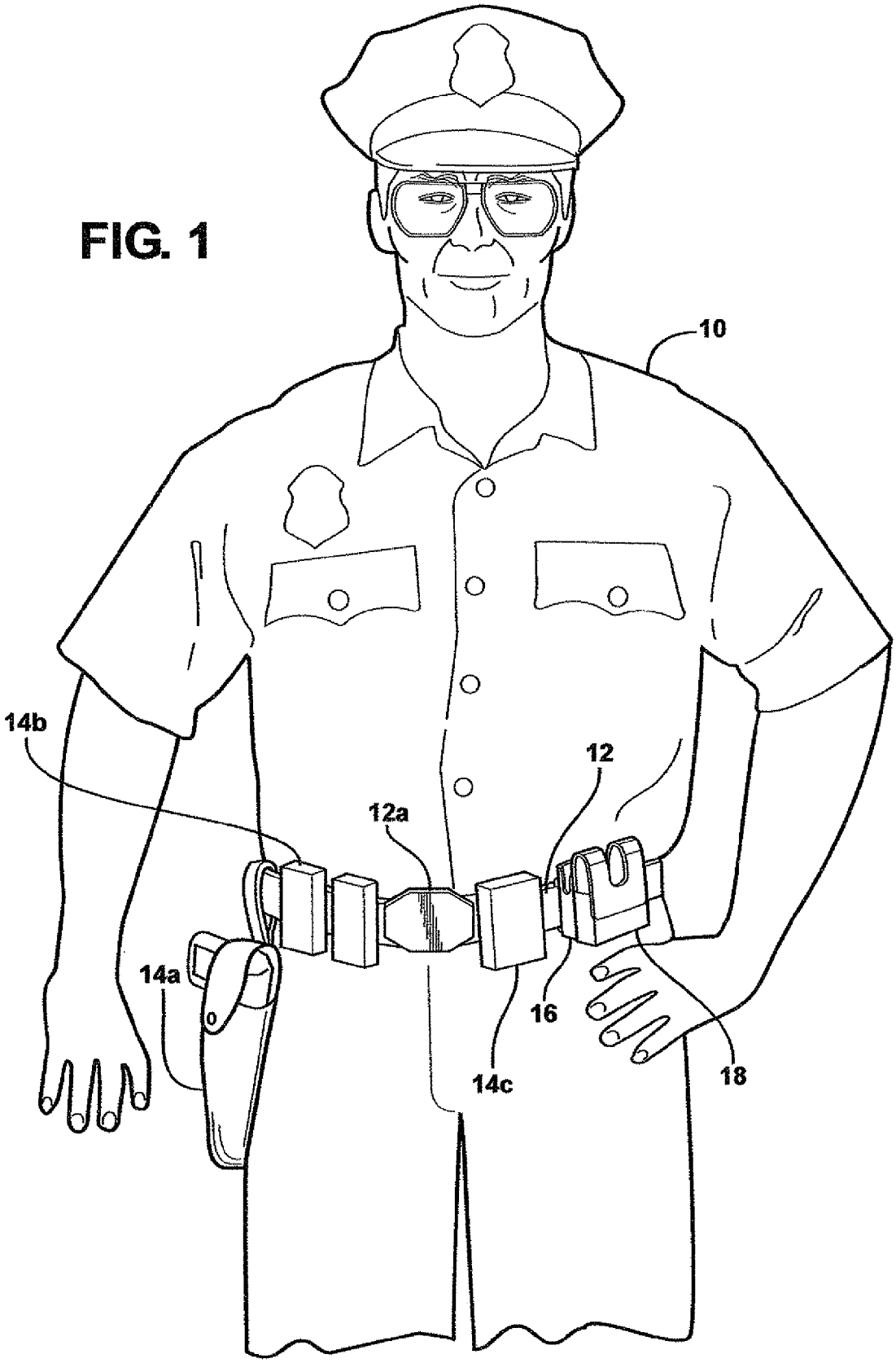
FIG. 1 is a perspective view of a user wearing a utility belt carrying an example of a magazine pouch and another ammunition pouch attached to an outboard side of the magazine pouch.

Also as shown in FIG. 1, the utility belt 12 can hold various item carriers or containers 14*a*, 14*b* and 14*c* that are configured to receive and carry different items, such as handcuffs, an electroshock weapon (e.g., a Taser), a handgun, a walkie-talkie or other communication device, a baton, or spare ammunition. The utility belt 12 can be integral with at least some of the item carriers 14*a*, 14*b* and 14*c*, such as by stitching the item carriers 14*a*, 14*b* and 14*c* to the utility belt 12. Also, the belt 12 and some or all of the item carriers 14*a*, 14*b* and 14*c* can be separate, in which case the item carriers 14*a*, 14*b* and 14*c* can each define a belt receiving slot through which the belt 12 can be inserted, a clip for attachment to the belt 12, or some other structure for attachment to the belt 12.

Figure 2:
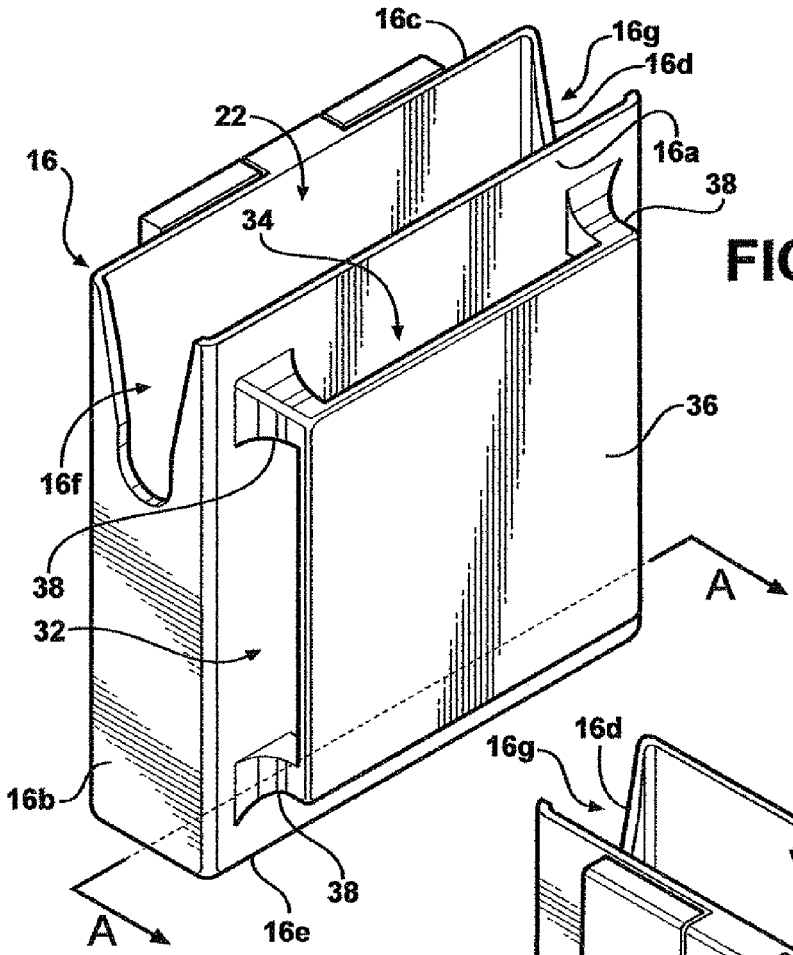
FIG. 2 is a perspective view of an inboard side of the magazine pouch of FIG. 1.
Figure 3:
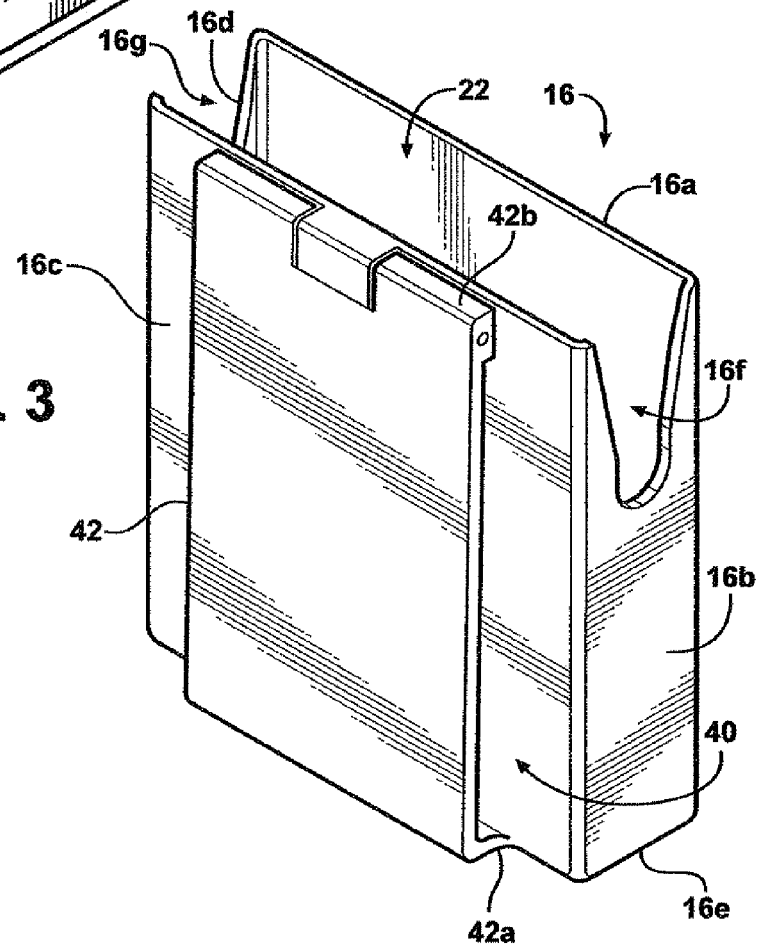
FIG. 3 is a perspective view of an outboard side of the magazine pouch of FIG. 1.

Still referring to FIG. 1, the utility belt 12 can also hold other types of containers, such as a magazine pouch 16 and another ammunition pouch 18 outboard of the magazine pouch 16. As shown in FIGS. 2 and 3, the magazine pouch 16 can have four sidewalls 16*a*, 16*b*, 16*c* and 16*d* extending generally perpendicularly from a bottom wall 16*e*, with sidewall 16*a* being an inboard sidewall whose outer surface faces the individual 10 when the magazine pouch 16 is attached to the belt 12, sidewall 16*c* being an outboard sidewall whose outer surface faces away from the individual 10 when the magazine is attached to the belt 12, and sidewalls 16*b* and 16*d* facing generally tangentially relative to a circumference defined by the belt 12 when the belt 12 is attached around the waist of the individual 10. Alternatively, the magazine pouch 16 can have a different shape, as an oval or octagon when viewed from above. Also, the pouch 16 can be coupled to a strap other than the belt 12, such as a suspender strap or an elastic waistline in a pair of pants.

Figure 4:
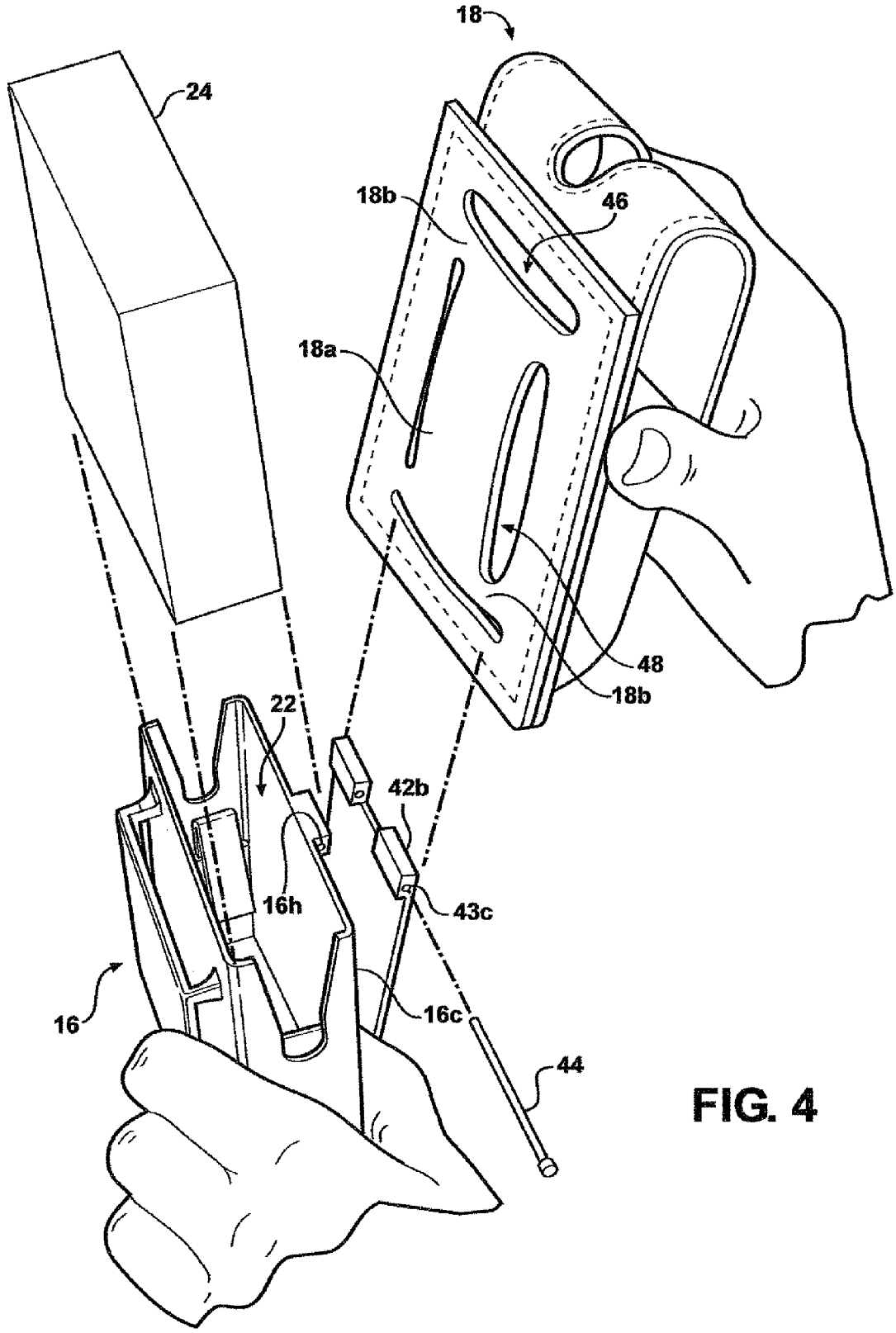
FIG. 4 is an exploded perspective view of the magazine pouch of FIG. 1 and another ammunition pouch.

The walls 16*a*-16*e* can define a cavity 22 having an open top as shown in FIGS. 2 and 3. The cavity 22 can be sized to receive a magazine 24 containing ammunition as shown in FIG. 4. For example, the width and thickness of the cavity 22 can be slightly larger than the width and thickness of the magazine 24 such that the magazine 24 can be inserted into the cavity 22, and the depth of the cavity 22 can be less than the length of the magazine 24 such that a portion of the magazine 24 extends out of the pouch 16 when fully inserted therein. For example, the cavity 22 can be sized to receive a 5.56/0.233 military magazine by spacing the sidewalls 16*a*-16*d* such that the 5.56/0.233 military magazine can be inserted therebetween, and the depth of the cavity 22 can be determined to achieve a balance between providing stability to the 5.56/0.233 military magazine when inserted into the cavity 22 and allowing the 5.56/0.233 military magazine to be easily gripped for removal from the magazine pouch 16. While the magazine pouch 16 is shown and described as having an open top cavity 22, the magazine pouch 16 can include a cover, such as a foldable flap that can be folded to extend over an exposed end of the magazine 24 when the magazine 24 is inserted into the pouch 16. Also, while the magazine pouch 16 is shown and described as being configured to receive a magazine 24, the pouch 16 can alternatively be configured to receive a different item (e.g., a pistol magazine, handcuffs, or another item), in which case the walls 16*a*-*e* of the pouch 16 can have different shapes such that the cavity 22 is sized to receive the different item.

Additionally, sidewalls 16*b* and 16*d* can define finger cutouts 16*f* and 16*g*, respectively. The cutouts 16*f* and 16*g* can be wider than a finger and thumb of an ordinary individual 10, such that the individual 10 can grip the magazine 24 when it is inserted into the cavity 22. For example, the cutouts 16*f* and 16*g* can have a maximal width of between 1.5" and 0.5" and can have a tapered end. The depth of the cutouts 16*f* and 16*g* can be a function of the difference between the depth of the cavity 22 and the length of the magazine 24, with the cutouts 16*f* and 16*g* having a larger depth as the depth of the cavity 22 approaches or exceeds the length of the magazine 24. For example, the cutouts 16*f* and 16*g* can have a depth of 1.0" to 3.0". As another example, if the length of the magazine 24 is sufficient for the magazine 24 to be easily gripped even when fully inserted into the cavity 22, the cutouts 16*f* and 16*g* need not be included.

Figure 6:
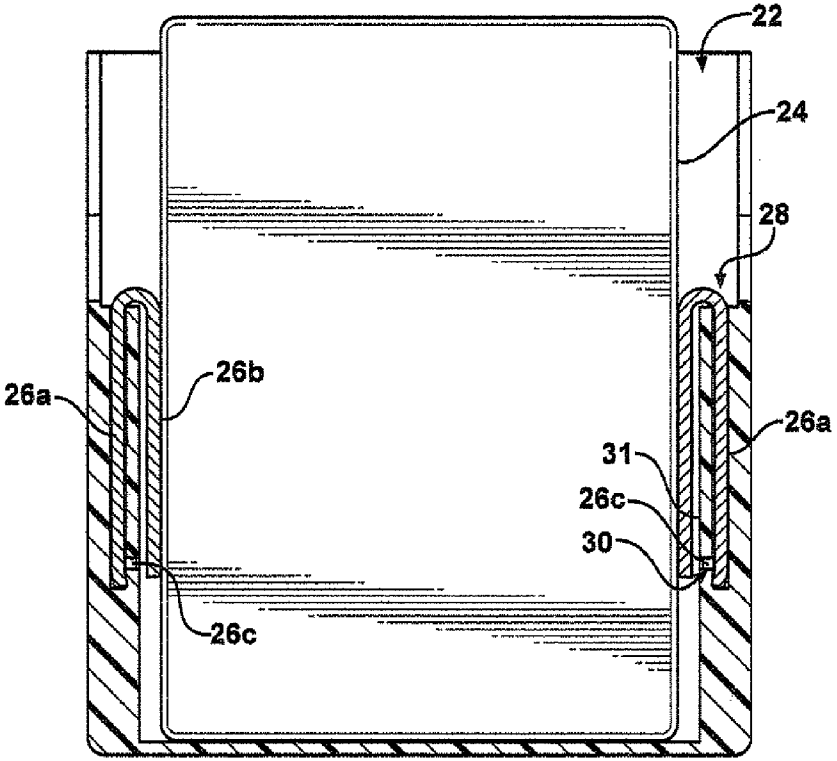
FIG. 6 is a cross-section of the magazine pouch of FIG. 1 with a magazine along line A-A as shown in FIG. 2.
Figure 5:
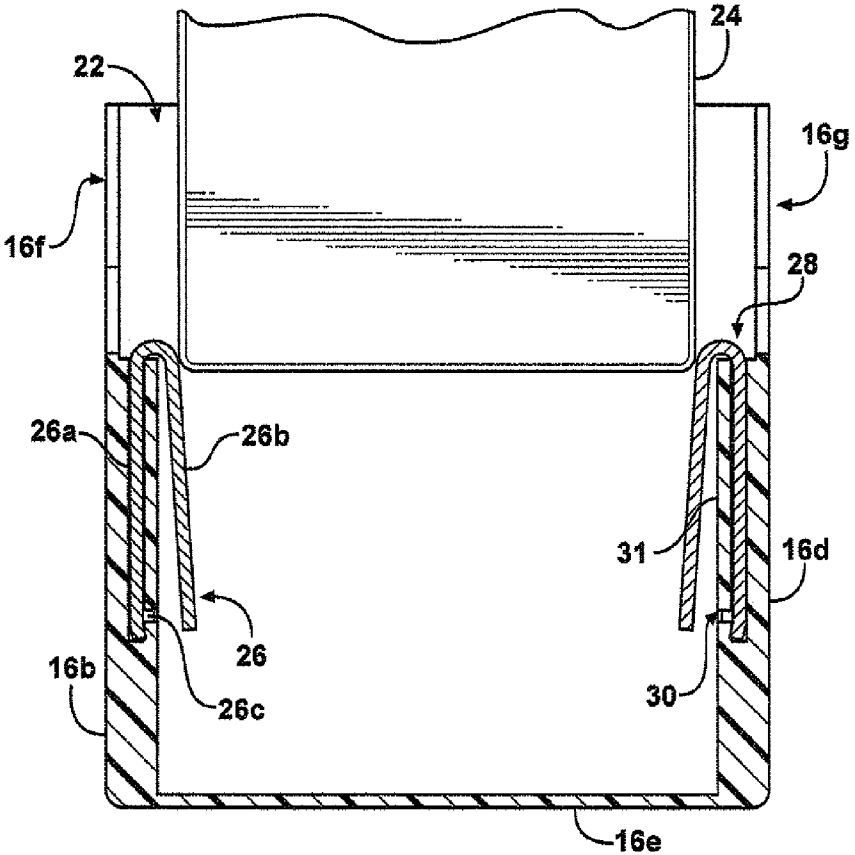
FIG. 5 is a cross-section of the magazine pouch of FIG. 1 without a magazine along line A-A as shown in FIG. 2.

As shown in FIGS. 5 and 6, biasing members such as resilient springs 26 can be disposed in the cavity 22 of the magazine pouch 16. Each spring 26, can have a linear portion 26*a* and a curvilinear portion 26*b*. The linear portion 26*a* of each spring 26 can include a nub 26*c*. The magazine pouch 16 can define a pair of slots 28 in the cavity 22, with one side of each slot defined by one of the sidewalls 16*b* or 16*d* and an opposing side of each slot 28 defined by a partition 31. Each partition 31 can define an aperture 30, and the partitions 31 can be spaced from their respective sidewalls 16*b* and 16*d* by a distance greater than a thickness of the linear portions 26*a* of the springs 26 and less than the thickness of the linear portions 26*a* plus the length of the nub 26*c*. The linear portion 26*a* of each spring 26 can be inserted into one of the slots 28 such that the curvilinear portion 26*b* of each spring 26 extends into the cavity 22.

Still referring to FIGS. 5 and 6, the nub 26*c* of each spring 26 can project into the aperture 30 defined by one of the partitions 31, thereby increasing the force required to remove the springs 26. Thus, the retention force applied to the springs 26 due to engagement between the springs 26 and slots 28 can be greater than friction forces on the springs 26 from removal of the magazine 24 from the magazine pouch 16, and the springs 26 can be securely engaged in the cavity 22. While the springs 26 are shown in FIGS. 5 and 6 as being inserted into slots 28 and held in place due to engagement between nubs 26*c* and apertures 30, the springs 26 can alternatively be held in place using clips, glue, or another structure.

Figure 7:
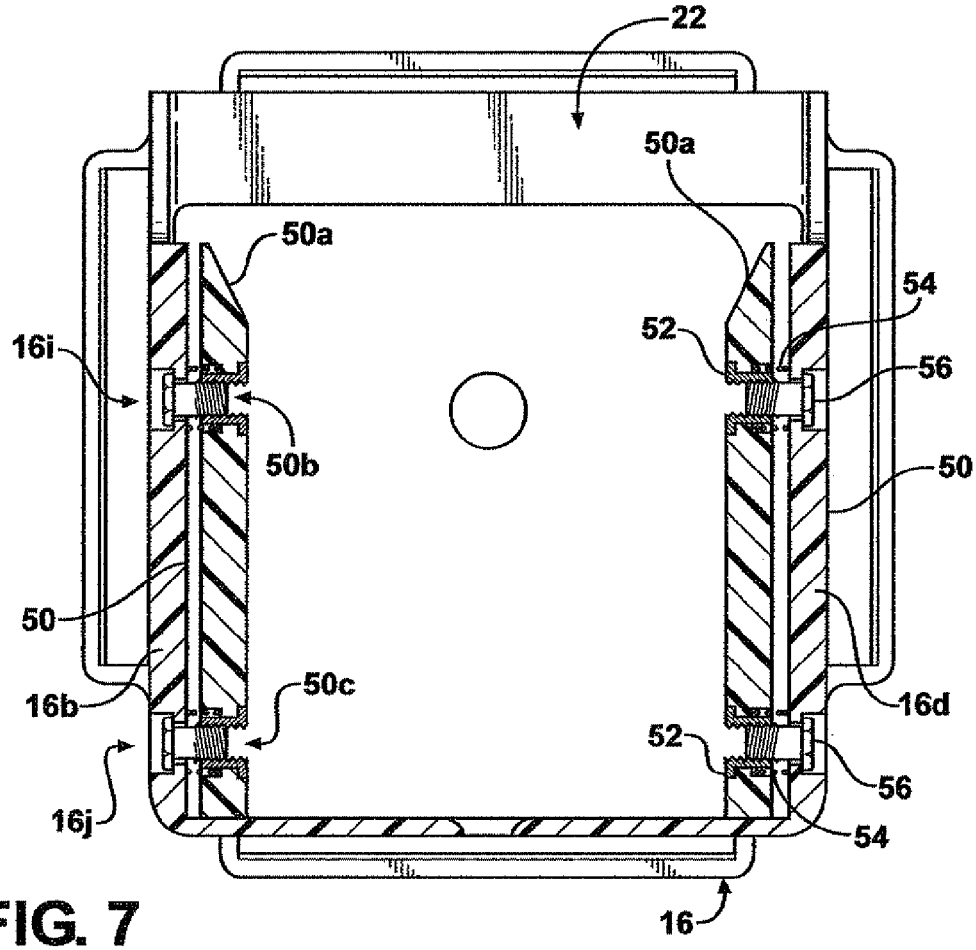
FIG. 7 is cross-sectional view of another example of a magazine pouch from the same location shown by line A-A.

With the springs 26 inserted into the slots 28, the distance between the curvilinear portions 26*b* of the springs 26 when the springs 26 are in an unbiased state can be less than the width of the magazine 24 as shown in FIG. 5. However, as shown in FIG. 6, inserting the magazine 24 into the cavity 22 can bias the curvilinear portions 26*b* of the springs 26 toward the sidewalls 16*b* and 16*d* by deforming the curvilinear portions 26*b* of the springs. As a result, the distance between the curvilinear portions 26*b* of the springs 26 when the springs 26 are in a biased state can be equal to the width of the magazine 24 as shown in FIG. 4. In the biased state, the springs 26 can exert pressure on the magazine 24 such that the frictional force between the springs 26 and magazine 24 is greater than the force of gravity, thereby preventing the magazine 24 from falling out of the pouch 16. The shape of the curvilinear portion 26*b* of each spring 26 can provide a large contact area between the each spring 26 and the magazine 24, thereby increasing the amount of friction between the two. However, the springs 26 can have an alternative shape than as shown in FIGS. 5-7, such as being formed of two angled linear portions or being blocks of resilient material (e.g., rubber).

Also, instead of springs 26, the magazine 24 can be held in the cavity 22 by a friction fit, a flap extending over the cavity 22, a magnet, or another magazine retainer. For example, FIG. 7 shows two rubber blocks 50, each having a beveled upper end 50*a*, disposed in the cavity of the magazine pouch 16. The blocks 50 can alternatively be made from a different material that can generate a sufficient amount of friction between the magazine 24 and blocks 50 to overcome the force of gravity on the magazine 24 in the event the pouch 16 is inverted. Each block 50 can define one or more apertures, such as apertures

50*b* and 50*c* as shown, and a threaded insert 52 can be disposed in each aperture 50*b* and 50*c*. The sidewalls 16*b* and 16*d* can also define apertures 16*i* and 16*j* spaced equally to apertures 50*b* and 50*c*. The blocks 50 can be inserted into the cavity 22 with a spring 54 disposed in each aperture 50*b* and 50*c* between the insert 52 and sidewall 16*b* or 16*d*. A bolt 56 can be inserted through one of the apertures 16*i* or 16*j*, then through a center of one of the springs 54, and then be engaged with one of the threaded inserts 52 in one of the apertures 50*b* or 50*c*. With this configuration, the blocks 50 can be biased laterally (relative to the orientation of the pouch 16 as shown in FIG. 7) toward their respective sidewalls 16*b* and 16*d* due to insertion of the magazine 24 into the cavity 22. That is, the magazine 24 can initially contact the beveled upper end 50*a* of each block 50, creating a lateral force on each block 50. In response, the block 50 is moved laterally toward its sidewall 16*b* or 16*d*, generating a force in each spring 54. Thus, removal of the magazine 24 requires overcoming the frictional force between the blocks 50 and the magazine 24. The blocks 50 can be replaced by removing bolts 56, and blocks 50 of different sizes can be installed to accommodate different sized magazines 24.

Referring back to FIG. 2, the inboard side 16*a* of the magazine pouch 16 can define a belt receiver, such as two perpendicular closed-loop slots 32 and 34, for receiving the belt 12. The inboard side 16*a* can include a plate 36 spaced from the inboard side 16*a*, with the slots 32 and 34 being the space between the plate 36 and inboard side 16*a*. Pillars 38 at each corner of the plate 36 can attach the plate 36 to the inboard side 16*a* of the magazine pouch 16. The distance between the pillars 38 can be at least the width of the belt 12 and the length of the pillars 38 can be at least the thickness of the belt 12 such that the belt 12 can be inserted between any two adjacent pillars 38 and between the plate 36 and sidewall 16*a*. Since the magazine pouch 16 defines two parallel slots 32 and 34, the pouch 16 can be attached to the belt 12 in four different orientations spaced at 90° intervals by inserting the belt 12 through one of the slots 32 and 34.

Figure 8:
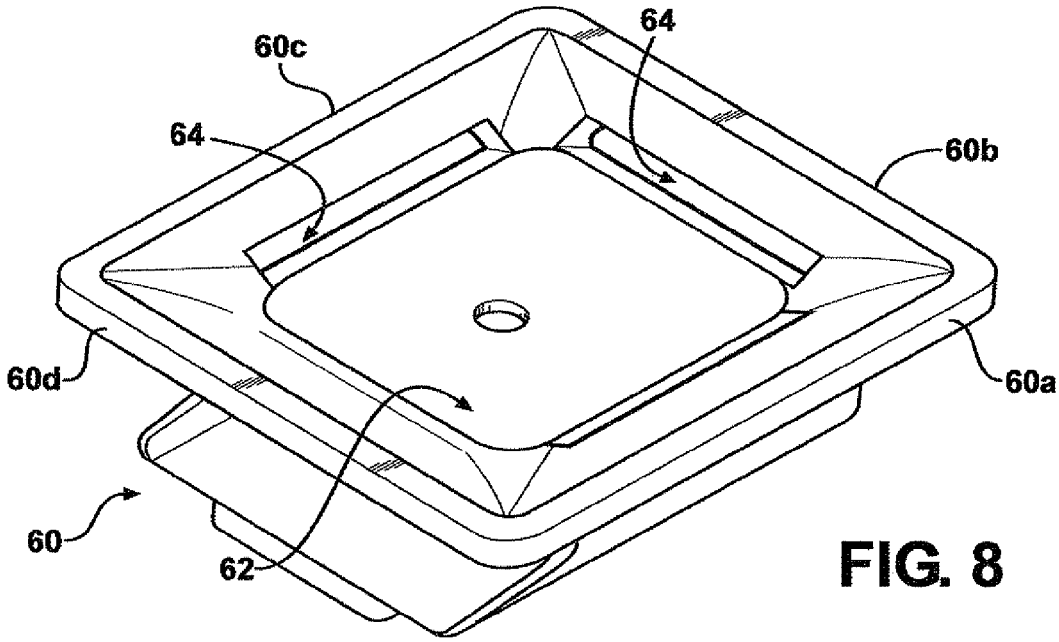
FIG. 8 is yet another example of a magazine pouch.

While the slots 32 and 34 are shown in FIG. 2 as being partially defined by the plate 36, slots for receiving the belt 12 can alternatively be formed with a different structure. For example, as shown in FIG. 8, another magazine pouch 60 can include four flanges 60*a-d* angled obliquely relative to an inboard side 62 of the pouch 60. The flanges 60*a-d* can be connected at their ends, as shown in FIG. 8, though the flanges 60*a-d* need not be connected. Each flange 60*a-d* can define a belt receiving slot 64. The slots 64 defined by flanges 60*a* and 60*c* can define a first belt receiving path, while the slots 64 defined by flanges 60*b* and 60*d* can define a second belt receiving path perpendicular to the first belt receiving path. Thus, the pouch 60 can be attached to the belt 12 in four different orientations at 90° intervals.

Referring back to FIG. 3, the outboard side 16*c* of the magazine pouch 16 can include a container receiver, such as slot 40 defined by the pouch 16, for receiving the ammunition pouch 18. For example, the outboard side 16*c* can include a clip 42 spaced from the outboard side 16*c*. The clip 42 can be pivotable relative to the outboard side 16*c*. For example, the clip 42 can be formed integrally with the outboard side 16*c*, with a lower end 42*a* of the clip 42 fixed to the outboard side 16*c*. The clip 42 can be made from a resilient material, such that the clip 42 can be bent away from the outboard side 16*c* for rotation. Alternatively, the lower end 42*a* of the clip 42 can be coupled to the outboard side 16*c* by a hinge or another pivoting structure.

To secure the clip 42 to the outboard side 16*c*, the upper end 42*b* of the clip 42 can be fastened to the outboard side 16*c*. For example, as shown in FIG. 4, the upper end 42*b* of the clip 42 can define one or more through-bores 42*b* and the outboard side 16*c* can define a through-bore 16*h*. Due to the connection as described above between the lower end 42*a* of the clip 42 and the outboard side 16*c*, the clip 42 can be naturally be biased toward a closed or container retaining position (shown in FIG. 3) in which the bores 42*c* defined by the clip 42 align with the bore 16*h* defined by the outboard side 16*c*. Alternatively, if the clip 42 is hingedly connected to the magazine pouch 16, a spring can be used to bias the clip 42 toward the closed position. A pin 44 can be inserted into the bores 16*h* and 42*c* when they are aligned (i.e., when the clip 42 is in a closed position), thereby coupling the upper end 42*b* of the clip 42 to the outboard side 16*c* to retain the clip 42 in the closed position.

As shown in FIG. 4, the pin 44 can be removed and the clip 42 can be biased away from the outboard side 16*c* to an open or container receiving position. The ammunition pouch 18 can include a strap 18*a* secured at its four corners 18*b* and defining two slots 46 and 48, and the ammunition pouch 18 can be coupled to the magazine pouch 16 by sliding the clip 42 into one of the slots 46 or 48 defined by the ammunition pouch 18. As a result, the ammunition pouch 18 can be coupled to the outboard side 16*c* of the magazine pouch 16 in four orientations oriented 90° from one another. Once the ammunition pouch 18 is coupled, the clip 42 can be positioned in the closed position as shown in FIG. 3 and the pin 44 can be inserted to retain the clip 42 in the closed position. As a result, the individual can carry the both the magazine pouch 16 and the ammunition pouch 18 on the utility belt.

While the clip 42 is shown as a container receiver, an alternative structure can be used for attaching the ammunition pouch 18 or other item carrying container to the magazine pouch 16. For example, a J-shaped bracket can project from the outboard side 16*c* of the magazine pouch 16 to receive the ammunition pouch 18, or one or more straps can have one end fixed to the magazine pouch 16 and the other end passed through one of the slots 46 and 48 in the ammunition pouch 18 before being snapped or otherwise attached to the magazine pouch 16. Also, while FIGS. 1 and 4 show the ammunition pouch 18 being coupled to the outboard side 16*c* of the magazine pouch 16, another type of pouch or item carrier (e.g., a handcuff holder) can alternatively be attached to the magazine pouch 16.

Also, while examples of a magazine pouch that are removeably couplable to another item carrier are shown in the FIGS., an alternative magazine pouch can be formed integrally with another item carrier. For example, a belt receiving slot can be formed in a sheet of material, such as leather, which can then be sewn or otherwise attached to an inboard side of an item carrier on three sides. The fourth side of the sheet, i.e., the side not attached to the item carrier, can provide an opening for inserting a magazine.

When the magazine pouch 16 and any other containers 14*a*, 14*b* and/or 14*c* are attached to the belt 12 as shown in FIG. 1, the belt 12 may bounce or flop around if the individual 10 wearing the belt 12 runs, jumps, or otherwise quickly changes a direction of travel. For example, if the belt 12 is made of a soft leather or nylon, the belt 12 may not be sufficiently stiff to prevent movement of the pouch 16 and any other containers 14*a*, 14*b* and/or 14*c* attached to the belt 12 when the individual makes certain movements. In order to reduce or eliminate movement of the magazine pouch 16, an auxiliary support paddle 100 can be attached thereto.

Figure 9:
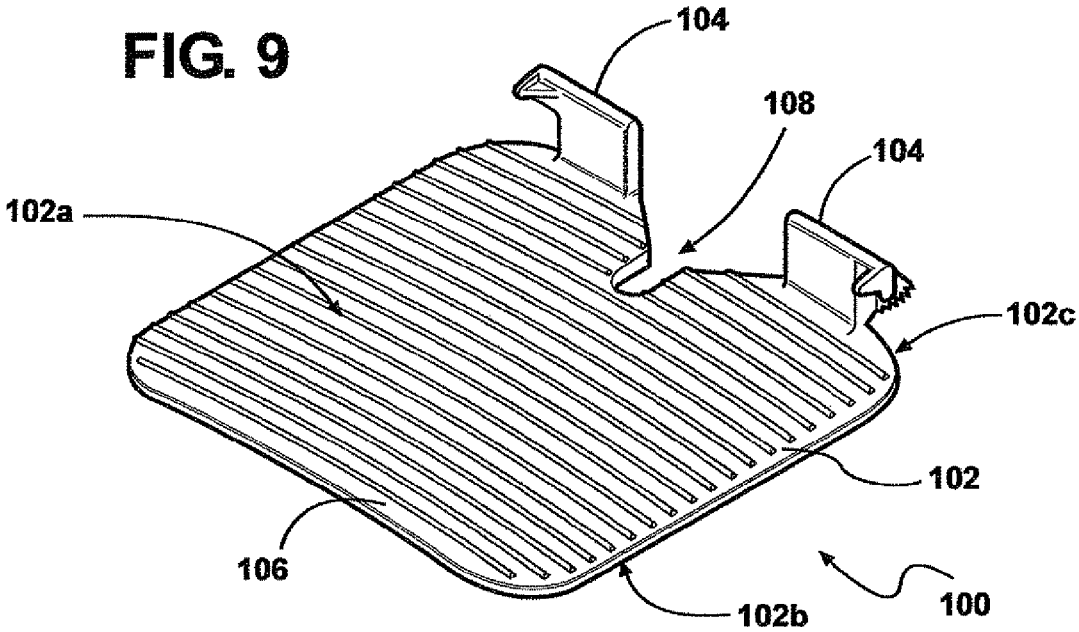
FIG. 9 is a perspective view of a paddle.
Figure 12:
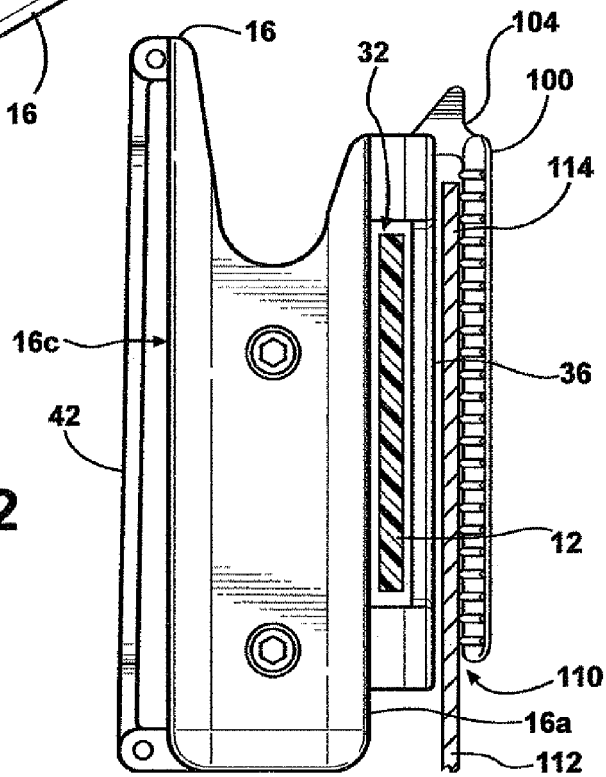
FIG. 12 is cross section of the magazine pouch of FIG. 1 having the paddle of FIG. 9 attached thereto and engaged with a belt and a pair of pants taken from a position spaced along the belt from the magazine pouch.

As shown in FIG. 9, the auxiliary support paddle 100 can include a plate portion 102 and a pair of arms 104. The paddle 100 can be made from a resilient material, such as a molded plastic (e.g., PVC or ABS). The plate 102 can have a first side 102*a* that faces the magazine pouch 16 when the plate 100 is attached to the pouch 16 and a second side 102*b* opposite the first side 100*a*. The first side 102*a* of the plate 102 can include an uneven friction increasing surface. For example, the first side 102*a* in FIG. 9 includes raised ridges 106, although the friction increasing surface can include an uneven surface having another shape, such as by including cylindrical or other shaped projections extending from the first side 102*a* of the plate 102. Alternatively, the first side 102*a* need not include friction increasing structures. As shown in FIG. 12, the plate 102 can define a hook or inverted J-shape. Also, instead of the plate 102, the paddle 100 can include a pair of spaced apart inverted J-shaped brackets or another similarly shaped structure.

Figure 10:
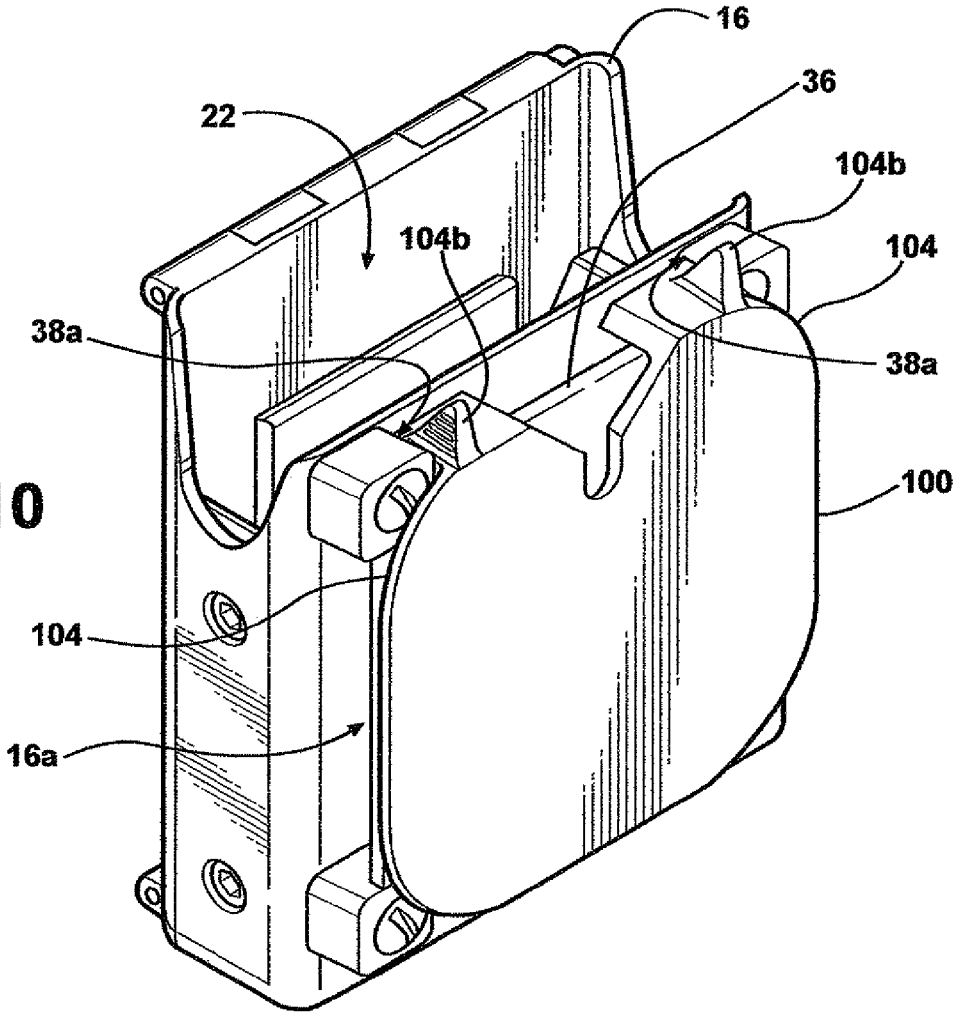
FIG. 10 is a first perspective view of the paddle of FIG. 9 attached to the magazine pouch of FIG. 1.
Figure 11:
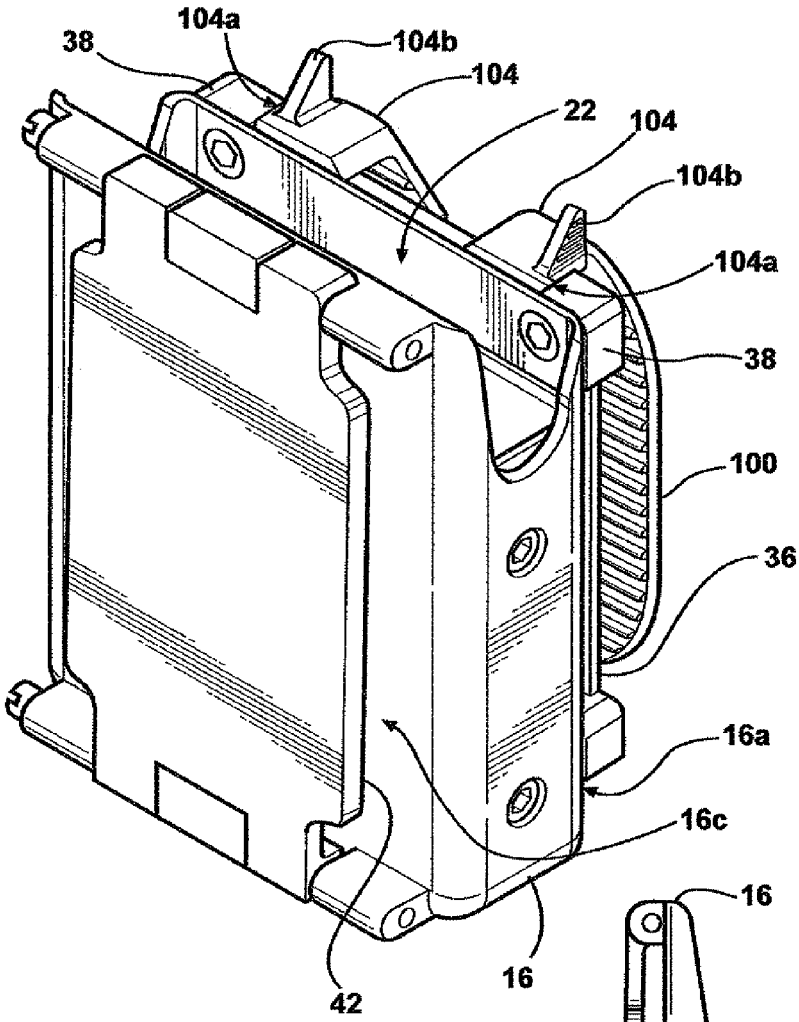
FIG. 11 is a second perspective view of the paddle of FIG. 9 attached to the magazine pouch of FIG. 1.

The arms 104 can both extend from an edge 102*c* of the plate 102, and the plate 102 can define a cutout 108 between the arms 104. The arms 104 can be configured to engage the magazine pouch 16 as shown in FIGS. 10 and 11. The arms 104 can have outer faces 104*a* and tabs 104*b* that project from arms 104. The tabs 104*b* can have ridges or other bumps thereon to increase friction such that the individual 10 can more easily push against the tabs 104*b*. The arms 104 can be configured to engage pillars 38 between the sidewall 16*a* of the magazine pouch 16 and the plate 36. A distance between the two pillars 38 nearest the opening of the cavity 22 can be equal to or slightly less than a distance between our faces outer faces 104*a* of the arms 104.

The arms 104 can be biased toward one another by the individual 10. For example, the individual 10 may press the tabs 104*b* toward one another, biasing the arms 104 into the cutout 108 slightly to reduce the distance between the outer faces 104. With the distance between the outer faces 104*a* reduced, the arms 104 can be positioned between the two pillars 38 nearest the opening of the cavity 22 as shown in FIGS. 10 and 11. After positioning the arms 104 between the two pillars 38, the individual 10 can release the arms 104, which can rebound toward their natural positions due to the resilient characteristics of the paddle 100. The outer faces 104*a* of the paddle 100 can exert a sufficient force against interior faces 38*a* of the two pillars 38 to secure the paddle 100 to the magazine pouch 16. Alternatively, the outer faces 104*a* of the paddle 100 can include projections (not shown) that are to be received by the apertures (not shown) in the magazine pouch 16 to further secure the paddle 100 to the pouch 16. For example, the interior faces 38*a* of the two pillars 38 near the opening of the cavity 22 can each define one or more apertures, and projections extending from the outer faces 104*a* of the paddle 100 can be shaped to snugly engage these indentations.

The paddle 100 can also be removed from the magazine pouch 16 by biasing the tabs 104*b* toward one another, thereby biasing the arms 104 into the cutout 108. Once the arms 104 are not engaged with the two pillars 38 nearest the opening of the cavity 22, the paddle 100 can be pulled from the magazine pouch 16. Thus, the paddle 100 can be selectively attached or detached from the magazine pouch 16. Alternatively, the paddle 100 can be attached to the magazine pouch in another manner. For example, the paddle 100 can be formed integrally with the magazine pouch 16, or the paddle 100 can be bolted or adhered to the pouch 16.

Referring now to FIG. 12, with the paddle 100 engaged with the magazine pouch 16, the plate 102 of the paddle 100 can extend generally parallel with the plate 36 of the magazine pouch 16, and a gap 110 can be formed between the two plates 102 and 36. The gap 110 can be closed along its top by the arms 104, while having two open sides and an open bottom. The open sides can be seen in FIG. 12 as extending into and out of the page. The belt 12 can be inserted through the slot 32 to attach the magazine pouch 16 to the belt. Additionally, the paddle 100 can be hooked a support 112, shown in FIG. 12 as garment (e.g., a pair of pants, shorts, or a dress) including a waistline 114 but which can alternatively be another structure such as a second belt. Hooking the paddle 100 over the support 112 can help stabilize the ammunition pouch 16 in the event that the individual 10 makes a sudden movement. For example, but for the paddle 100 being engaged with one of the support 112 the ammunition pouch 16 might move a substantial distance in response to a sudden movement by the individual 10, and engaging the paddle 100 with the support 112 can help arrest motion of the ammunition pouch 16 during any such movement. Thus in addition to being secured to the individual 10 by the belt 12, the magazine pouch 16 can be engaged with the support 112.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A wearable item carrier for use with a utility belt comprising:

a first container having a first side including a belt receiver attached to the first side by two pillars extending between the first side and the belt receiver, and a second side opposite the first side including a container receiver; and an auxiliary support paddle having a pair of arms extending from a plate portion, the paddle attached to the first container by engagement of the each of the pair of arms with a respective pillar to define a gap between the plate portion and the belt receiver having two open sides and an open bottom, wherein the arms are movable between a first position in which a distance between outer faces of the arms is at least as great as a distance between the two pillars and a second position in which the distance between the outer faces of the arms is at less than the distance between the two pillars.

2. The wearable item carrier of claim 1, wherein the auxiliary support paddle is removably attached to the first container.

3. The wearable item carrier of claim 1, wherein each of the arms exerts a force against the respective pillar in response to being disposed therebetween.

4. The wearable item carrier of claim 1, wherein the auxiliary support paddle is resilient and the arms exert forces toward the pillars in response to being biased toward the second position.

5. The wearable item carrier of claim 1, wherein the auxiliary support paddle defines a cutout between the two arms, and wherein the cutout is reduced in size when the arms are in the second position compared to the first position.

6. The wearable item carrier of claim 1, wherein each arm includes a tab extending there from in a direction orthogonal to a direction between the arms.

7. The wearable item carrier of claim 1, wherein a side of the auxiliary support paddle facing the first container includes an uneven friction increasing surface.

8. The wearable item carrier of claim 7, wherein the uneven friction increasing surface includes a series of ridges.

9. An item carrier to be worn by an individual, the belt comprising:

a main body defining a compartment and including a belt receiver attached on a first side of the main body by two pillars extending between the first side and the belt receiver to define at least one slot, and including a container receiver on a second side of the main body opposite the first side;

a utility belt inserted through the at least one slot and secured around a waist area of the individual; and an auxiliary support paddle having pair of arms extending from a plate portion and attached to the main body by engagement of the each of the pair of arms with a respective pillar, the paddle and belt receiver of the main body defining a gap therebetween having two open sides and an open bottom, wherein the arms are movable between a first position in which a distance between outer faces of the arms is at least as great as a distance between the two pillars and a second position in which the distance between the outer faces of the arms is at less than the distance between the two pillars.

10. The wearable item carrier of claim 9, wherein the auxiliary support paddle is removably attached to the main body.

11. The wearable item carrier of claim 9, wherein the arms exert a force against the two pillars in response to being disposed therebetween.

12. The wearable item carrier of claim 9, wherein the auxiliary support paddle is resilient and the arms exert forces toward the pillars in response to being biased toward the second position.

13. The wearable item carrier of claim 9, wherein the auxiliary support paddle defines a cutout between the two arms, and wherein the cutout is reduced in size when the arms are in the second position compared to the first position.

* * * * *